US005464139A

United States Patent [19]

Schuchmann

[11] Patent Number: 5,464,139

[45] Date of Patent: Nov. 7, 1995

[54] CADDY CLIP

[76] Inventor: Stanley Schuchmann, 150 Himmel, Moscow Mills, Mo. 63362

[21] Appl. No.: 234,358

[22] Filed: Apr. 28, 1994

[51] Int. Cl.[6] ..... A45F 5/02

[52] U.S. Cl. ..... 224/269; 224/252; 224/247; 24/336; 24/339

[58] Field of Search ..... 224/242, 245, 224/247, 248, 252, 253, 269, 271, 272, 904; 24/3 F, 3 J, 3 L, 3 R, 305, 329, 335, 336, 339

[56] References Cited

U.S. PATENT DOCUMENTS

| | | | |
|---|---|---|---|
| 969,524 | 9/1910 | Condon | 224/253 X |
| 1,081,261 | 12/1913 | Barrett | 224/247 X |
| 2,589,126 | 3/1952 | Payne | 224/247 |
| 3,599,847 | 8/1971 | Danielson | 224/253 |
| 3,610,487 | 10/1971 | Campos | 224/253 |
| 3,642,184 | 2/1972 | Hendricks | 224/253 X |
| 4,100,652 | 7/1978 | Carlson | 24/3 R |
| 4,718,586 | 1/1988 | Hagino | 224/252 |
| 4,883,290 | 11/1989 | Landa | 224/252 |
| 4,915,279 | 4/1990 | Galbraith | 224/230 |

*Primary Examiner*—J. Casimer Jacyna
*Attorney, Agent, or Firm*—Henry W. Cummings

[57] ABSTRACT

A CADDY CLIP™ (10) is described to enable a golfer to carry a club with him when he is chipping and putting around the green. The CADDY CLIP (10) includes a U-shaped portion (12) having a leg (14) which extends inside the golfer's belt. The leg (14) extends a significant distance parallel and in contact with the golfer's belt and includes a bend (16) to facilitate gripping and holding the clip in place on the golfer's belt. An arcuate portion (18) extends over the golfer's belt and a second leg 19 extends downwardly for a distance of about one to two inches. A fastener (20) holds in place a lower depending leg (21), extending downwardly from U-shaped member (12). This is a safety feature for the golfer whereby if the golfer trips either with a club in the device or if the CADDY CLIP is empty, the leg (20) can pivot and avoid harming the golfer in the event of a fall. To hold the club in place a pair of laterally extending clip devices (22, 24) are provided which are either formed integrally with the leg (21) or are rigidly connected to the leg (21) by suitable fasteners (not shown). The clip devices (22, 24) extend laterally outwardly from the leg (21) in opposite directions, (25, 27), and include resilient arcuate portions (26, 28), generally parrallel to leg 21 for gripping the shaft of the club. The material used for clips (22,24) must be sufficiently resilient to allow them to bent during attachment of the club shaft, and yet be sufficiently rigid to hold the club shaft in place while it is carried in the clips. The arcuate portion of clip 22 must be sufficiently small to hold the head of the club in place while the golfer is walking.

9 Claims, 2 Drawing Sheets

CADDY CLIP

BACKGROUND OF THE INVENTION

U.S. Pat. No. 2,589,126 discloses a device to fit over the golfer's belt to hold a golf club wile walking. The device is U-shaped and includes one leg which fits on the inside of the belt while the second leg which fits outside of the belt. Attached to the second leg is an arcuate, resilient flap into which is placed the golf club for carrying.

In U.S. Pat. No. 4,915,279 a U-shaped member is also disclosed for fitting over the golfer's belt. Again one portion fits inside the belt and the second portion fits outside the belt. In the outer member a slot is provided which receives the handle of the golf club.

In U.S. Pat. No. 4,830,248 a U-shaped device is provided for fitting on a golf bag in which one leg fits inside the golf bag and the second leg fits outside the golf bag. In the outer leg openings are provided to receive tees and a scoring pencil.

In U.S. Pat. No. 1,270,158 a tool holder is provided which includes a U-shaped member in which one leg fits inside the worker's belt and the second leg extends out of the belt. The leg extending outside the belt includes an upper arcuate portion to receive a portion of a tool and a pair of downwardly extending arcuate portions to receive additional tools.

In U.S. Pat. No. 4,830,247 a U-shaped member is provided to support a holster for a caulking gun. One leg fits inside the wearer's belt and a second leg is extends downwardly a substantial distance and includes several outwardly extending resilient snaps to receive, hold, and remove the caulking gun.

In U.S. Pat. No. 2,942,314 a clamping device for a chord includes arcuate members extending in opposite directions to grip the chord.

In U.S. Pat. No. 4,861,081 a tool is removably held in place by a pair of oppositely directed arcuate clamp members extending upwardly from a base.

SUMMARY OF THE INVENTION

A) Objects of the Invention

One of object of the present invention is to provide a device to a hold golf club preferably a chipping club or a putter on the golfer's belt so that he will not leave such clubs behind when putting or chipping around the green.

Another object of the present invention is a golf club holding device which includes a safety feature whereby if the golfer should trip with the device in place, the device would give and would not harm the golfer.

Another object of the present invention is to provide such a device which is inexpensive to manufacture.

Another object of the present invention is to provide such a device that is easy to fabricate.

B) Summary

In according with the present invention a CADDY CLIP™ (10) is provided to enable a golfer to carry a club with him when he is chipping and putting around the green.

The CADDY CLIP™ of the present invention (10) includes a U-shaped portion (12) having a leg (14) which extends inside the golfer's belt. The leg (14) extends a significant distance parallel and in contact with the golfer's belt and includes a bend (16) to facilitate gripping and holding the clip in place on the golfer's belt.

an arcuate portion (18) extends over the golfer's belt and a second leg 19 extends downwardly for a distance of about one to two inches. A fastener (20) holds in place a lower depending leg (21), extending downwardly from U-shaped member (12).

This is a safety feature for the golfer whereby if the golfer trips either with a club in the device or if the CADDY CLIP™ is empty, the leg (20) can pivot and avoid harming the golfer in the event of a fall.

To hold the club in place a pair of laterally extending clip devices (22, 24) are provided which are either formed integrally with the leg (21) or are rigidly connected to the leg (21) by suitable fasteners (not shown). The clip devices (22, 24) extend laterally outwardly from the leg (21) in opposite directions (25,27), and include resilient arcuate portions (26, 28), generraly parrallel to leg 21 for gripping the shaft of the club.

The material used for clips (22,24) must be sufficiently resilient to allow them to bent during attachment of the club shaft, and yet be suffeciently rigid to hold the club shaft in place while it is carried in the clips. The arcuate portion of clip 22 must be sufficiently small to hold the head of the club in place while the golfer is walking.

THE DRAWINGS

DESCRIPTION OF PREFERRED EMBODIMENTS

Figure 2:
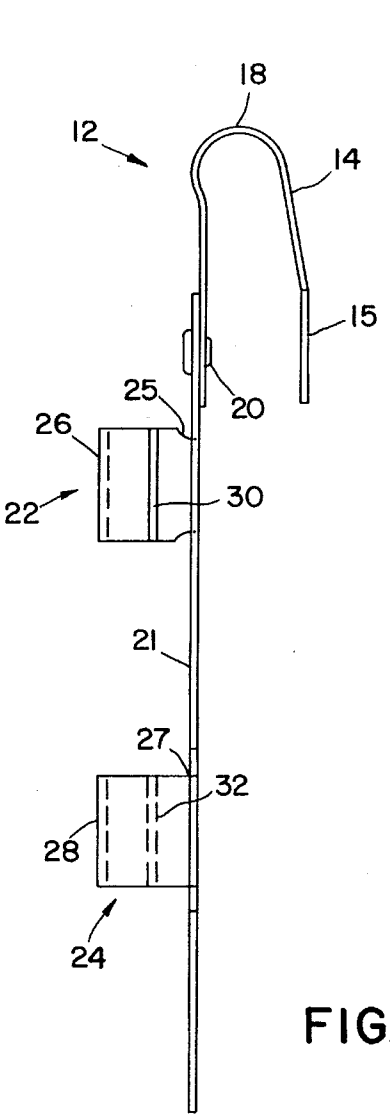
FIG. 2 is a side elevation view of the CADDY CLIP of the present invention.
Figure 1:
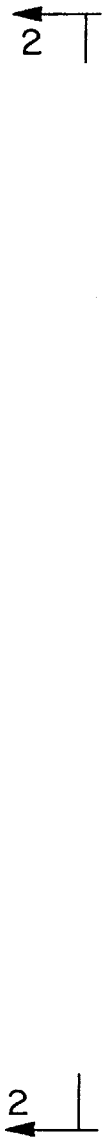
FIG. 1 is a front elevation view of the CADDY CLIP™ of the present invention.
Figure 1:
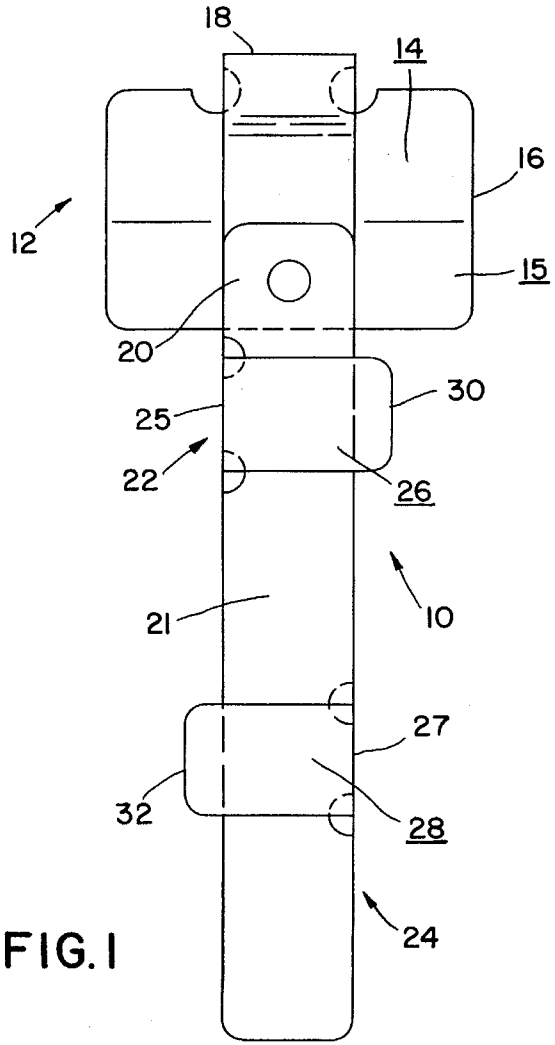
Figure 3:
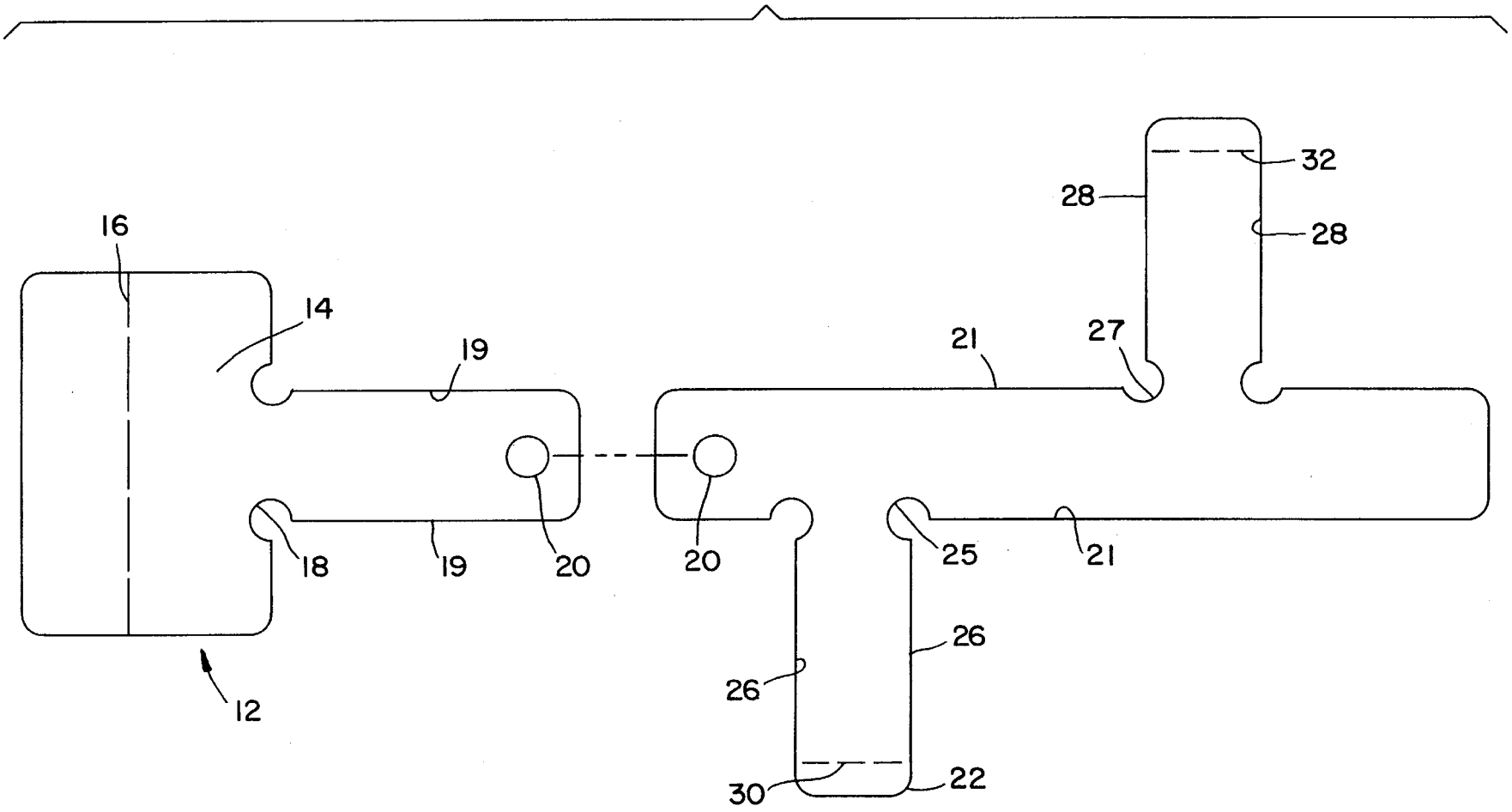
FIG. 3 is an exploded view of the CADDY CLIP of the present invention.

In accordance with the present invention a CADDY CLIP™ is provided to enable a golfer to carry a club with him when he is chipping and putting around the green.

Whether the golfer is using an electric cart with the clubs on the cart, using a pull cart, or carrying his/her club, the normal practice is to leave the bag containing the other clubs behind and take out a chipping club and a putter as the golfer chips near the green, and then putts on the green.

Frequently the golfer will leave either the chipping club or the putter behind, on, or near, the green.

It is a nuisance to have to return from a succeeding hole to look for such a club which has been left behind. This is particularly true if the golfer is walking.

Furthermore frequently the clubs simply cannot be found and another golfer has placed the club in his own bag.

It is expensive to replace such a lost or stolen club.

The CADDY CLIP™ of the present invention (10) includes a U-shaped portion (12) having a leg (14) which extends inside the golfer's belt. The leg (14) extends a significant distance parallel and in contact with the golfer's belt and includes a bend (10) to facilitate gripping and holding the clip in place on the golfer's belt.

As an example, the transverse extent of the leg (14) may be two to three inches and the vertical extent may be one to three inches. The bend (16) be about one-half to one inch down from the top.

An arcuate portion (18) extends over the golfer's belt and a second leg 19 extends downwardly for a distance of about one to two inches. A fastener (20) holds in place a lower depending leg (21), extending downwardly from U-shaped member (12). The second leg (19) extends downwardly a distance of about one-half inch to one inch behind leg (21) to provide support for depending leg (21).

The fastener (20) may be a rivet, screw or other fastener which allows the leg (21) to pivot with respect to the U-shaped member (14).

This is a safety feature for the golfer whereby if the golfer trips either with a club in the device or if the CADDY CLIP™ is empty, the leg (20) can pivot and avoid harming the golfer in the event of a fall.

To hold the club in place a pair of laterally extending clip devices (22, 24) are provided which are either formed integrally with the leg (21) or are rigidly connected to the leg (21) by suitable fasteners (not shown). The clip devices (22, 24) extend laterally outwardly from the leg (21) in opposite directions, (25,27), and include resilient arcuate portions (26, 28), generraly parrallel to leg 21 for gripping the shaft of the club. Outwardly extending tab portions (30, 32) facilitate holding the club in place and providing ease of attachment of the club and removal of the club. The material used for clips (22,24) must be sufficiently resilient to allow them to bend during attachment of the club shaft, and yet be sufficiently rigid to hold the club shaft in place while it is carried in the clips. The arcuate portion of clip 22 must be sufficiently small to hold the head of the club in place while the golfer is walking.

In accordance with another feature of the invention, it was round that if only the single clip member (22) is used that clubs tend to slip out of the device while the golfers are walking.

However when a second clipping device (24) was added the problem of clubs slipping out while the golfer is walking was overcome.

Clip (22) is spaced downwardly from fastener (20) one-half inch to one inch. Clip member (24) is spaced downwardly from clip member (22) about one to three inches.

The entire length of member (21) can be four to six inches.

The radius of the curvature of the arcuate portions (26, 28) can be from one-quarter to one-half inch.

The CADDY CLIP may be made as a stamping out of metal including steel or aluminum. Or it may be fabricated from suitable commercially available plastic materials in which the device may be molded or extruded as is known by those skilled in plastic fabrication art.

In use the golfer simply places the leg (14) of the U-shaped member on the inside of his belt and allows the leg portion (18) to extend over his belt and the portion (19) to extend down adjacent either of his legs.

When the golfer is close to the green if his/her ball is not on the green, he can take his putter and clip it is place by overcoming the resiliency of the clip members (22, 24) and carry the putter with him in the CADDY CLIP. He can carry his chipping club in the CADDY CLIP after he has made a chip shot and placed the ball on the green, and carry his putter to the green in order to putt.

With the CADDY CLIP in use the problem of the golfer leaving the club either on or around the green is essentially overcome.

As a safety feature,the connection of fastener (20) between the U-shaped member (12) and the leg (21) should be such as to allow the leg (21) to pivot about the pivot point (20) in the event that the golfer should fall.

In addition the clip members (22, 24) must have sufficient resiliency in the arcuate portions (26, 28) to hold the club in place while the golfer is walking and at the same time allow the club to be removed by overcoming the resiliency of the clip members.

What is claimed is:

1. A caddy clip for holding golf clubs in place adjacent the golfer's body comprising:

a generally U-shaped member having a first leg adapted to be located inside the golfer's belt and including a transverse portion extending a significant distance in engagement with the inner surface of the golfer's belt;

an arcuate portion extending upwardly and going over the golfer's belt and joining;

a second leg extending downwardly parallel to said first leg;

said second leg including means for pivotally mounting a lower depending leg for relative movement between said second leg and said depending leg;

said depending leg including a downwardly extending portion including at least one pair of oppositely directed vertically spaced upper and lower clip members mounted upon said depending leg;

each of said clip members extending laterally from said downwardly extending leg in different directions and each including an arcuate portion adapted to removably engage the shaft of a golf club;

the upper clip member adapted to engage and support a golf club head; whereby the caddy clip is supported by the golfer's belt; a golf club can be removably carried by said caddy clip with the head of the club engaging said upper clip member, and the shank of the club located within and engaged by each of said arcuate portions of upper and lower clip members.

2. A caddy clip according to claim 1 made of a material selected from metal and plastic materials.

3. A caddy clip according to claim 2 wherein the metal material is selected from steel and aluminum alloys.

4. A caddy clip according to claim 1 wherein a screw is used to hold said depending leg in place.

5. A caddy clip according to claim 1 wherein a rivet is used to hold said depending leg to in place.

6. A caddy clip according to claim 1 wherein the clip members are formed integrally with said depending leg members.

7. A caddy clip according to claim 1 wherein the radius of the curvature of said clip portion is from one-quarter to one-half inch.

8. A caddy clip according to claim 7 wherein said dependent leg extends at least about three inches being said U-shaped member.

9. A caddy clip according to claim 8 wherein said first leg extends at least one and one-half inches in engagement with the wearer's belt.

* * * * *